US006038863A

United States Patent [19]

Keller et al.

[11] Patent Number: 6,038,863

[45] Date of Patent: Mar. 21, 2000

[54] BURNER ARRANGEMENT FOR A GAS TURBINE FOR PREVENTING THE INGRESS OF FLUIDS INTO A FUEL PASSAGE

[75] Inventors: Jakob Keller, Wohlen; Paul Marlow, Baden, both of Switzerland; Robin McMillan, Bardney Lincolnshire, United Kingdom; Martin Valk, München, Germany

[73] Assignee: Asea Brown Boveri AG, Baden, Switzerland

[21] Appl. No.: 08/984,688

[22] Filed: Dec. 3, 1997

[30] Foreign Application Priority Data

Dec. 19, 1996 [DE] Germany ..... 196 52 899

[51] Int. Cl.[7] ..... F23R 3/28; F23R 3/36

[52] U.S. Cl. ..... 60/742; 60/746; 60/737

[58] Field of Search ..... 60/746, 748, 742, 60/737

[56] References Cited

U.S. PATENT DOCUMENTS

| | | | |
|---|---|---|---|
| 3,691,765 | 9/1972 | Carlisle | 60/742 |
| 3,763,650 | 10/1973 | Hussey et al. | 60/737 |
| 5,062,792 | 11/1991 | Maghon | 60/746 |
| 5,337,961 | 8/1994 | Brambani et al. | 60/742 |
| 5,615,555 | 4/1997 | Mina | 60/742 |
| 5,664,943 | 9/1997 | Joos et al. | 60/746 |
| 5,765,366 | 6/1998 | Beeck et al. | 60/742 |
| 5,782,626 | 7/1998 | Joos et al. | 431/8 |
| 5,884,471 | 3/1999 | Anderson et al. | 60/740 |

FOREIGN PATENT DOCUMENTS

| | | |
|---|---|---|
| 0692675A2 | 1/1996 | European Pat. Off. . |
| 0780628A | 6/1997 | European Pat. Off. . |
| 2 570 473 | 3/1986 | France . |
| 1992617 | 8/1968 | Germany . |
| 1282355 | 11/1968 | Germany . |
| 4109304A1 | 9/1992 | Germany . |
| 4306956A1 | 9/1994 | Germany . |
| 2122333 | 1/1984 | United Kingdom . |

*Primary Examiner*—Ted Kim

*Attorney, Agent, or Firm*—Burns, Doane, Swecker & Mathis, L.L.P.

[57] ABSTRACT

The burner arrangement for a gas turbine comprises at least one burner (2), which is arranged in the plenum of the gas turbine and leads with an inner injection space into a combustion chamber and to which compressed air is admitted on the outside from a compressor stage of the gas turbine. Furthermore, a fuel lance (9) for the alternative feeding of liquid and/or gaseous fuels is allocated to the burner (2), which fuel lance (9) has a central liquid-fuel tube (19) and a pilot gas tube (11) concentrically surrounding the liquid-fuel tube (19), the tubes (11, 19) ending in associated outlet openings (22, 23, 23*a–c*) in a lance head (12) at the tip of the fuel lance (9). In order to provide protection from an ingress of hot gases and/or hot liquid fuel into the outlet openings (22, 23, 23*a–c*) of the tubes (11, 19) when these tubes are not being used, an additional opening (17) is provided in the lance head (12) in the immediate vicinity of the outlet openings (22, 23, 23*a–c*), through which additional opening (17) compressed air flows out into the injection space (8). Furthermore, means are provided which direct compressed air from the plenum, surrounding the burner (2), to the additional opening (17).

10 Claims, 3 Drawing Sheets

BURNER ARRANGEMENT FOR A GAS TURBINE FOR PREVENTING THE INGRESS OF FLUIDS INTO A FUEL PASSAGE

BACKGROUND OF THE INVENTION

1. Field of the Invention

The present invention relates to the field of burner technology for gas turbines. It relates to a burner arrangement for a gas turbine, comprising at least one burner, which is arranged in the plenum of the gas turbine and leads with an inner injection space into a combustion chamber and to which compressed air is admitted on the outside from a compressor stage of the gas turbine, and also a fuel lance allocated to the burner and intended for the alternative feeding of liquid and/or gaseous fuels, which fuel lance has a central liquid-fuel tube and a pilot-gas tube concentrically surrounding the liquid-fuel tube, the tubes ending in associated outlet openings in a lance head at the tip of the fuel lance, and which fuel lance can be inserted with the lance head into an inner tube, connected to the injection space, of the burner.

Such a burner arrangement is disclosed, for example, by German Offenlegungsschrift DE-A1-43 06 956.

2. Discussion of Background

Combustion chambers having so-called double-cone burners, to which fuel is fed from outside through insertable burner lances (see the publication mentioned at the beginning), have for a long time proved successful for stationary gas turbines in power stations. In this case, the fuel lance is usually designed as a dual fuel lance, i.e. gaseous fuel (pilot gas) and liquid fuel (normally an oil/water mixture) can be fed alternatively in the fuel lance. To this end, appropriate tubes (liquid-fuel tube, pilot-gas tube) are arranged concentrically in the lance and form passages for the gas and the liquid fuel. The passages end at the lance tip (in the lance head) in associated outlet openings for the respective fuel. The lance head of the lance is in a corresponding inner tube of the burner, so that the issuing fuel passes into the injection space adjoining the inner tube.

During normal oil operation, an oil/water mixture flows in the inner liquid-fuel tube (liquid-fuel passage) of the fuel lance. In the starting phase, however, in gas operation, pilot gas flows in the annular pilot-gas passage between the liquid-fuel tube and the pilot-gas tube. Here, one of the two fuel passages is always out of service. Sometimes, even both passages are out of use simultaneously.

Since the requisite positive pressure relative to the injection space of the burner is absent in the passages which are not being used, an ingress of hot gases or hot oil from the burner into the passages which are not being used may occur and may lead to temporary or permanent impairment of the function of the fuel lance. It would therefore be desirable to design the burner arrangement in such a way that such an ingress is reliably prevented in a simple manner.

SUMMARY OF THE INVENTION

Accordingly, one object of the invention is to provide a novel burner arrangement in which the ingress of hot gases or hot oil from the burner into a burner-lance fuel passage which is not being used is reliably avoided at little cost.

This object is achieved in a burner arrangement of the type mentioned at the beginning in that, in order to provide protection from an ingress of hot gases and/or hot liquid fuel into the outlet openings of the tubes when these tubes are not being used, an additional opening is provided in the lance head in the immediate vicinity of the outlet openings of the tubes, through which additional opening compressed air flows out into the injection space, and that means are provided which direct compressed air from the plenum, surrounding the burner, to the additional opening. In this way, an air shield which reliably prevents a backflow into the outlet openings is produced at the lance head in the immediate vicinity of the outlet openings of the fuel tubes. Since the compressed air required for this is extracted directly at the burner from the surrounding plenum, additional lines in the lance and toward the lance as well as associated connections, valves and the like are dispensed with.

A first preferred embodiment of the burner arrangement according to the invention is distinguished by the fact that the means for directing the compressed air comprise an intermediate space which is arranged upstream of the lance head in the direction of flow, between the pilot-gas tube and the inner tube of the burner, that the intermediate space is connected to the plenum, surrounding the burner, via at least one inlet bore leading from outside through the burner into the inner tube, that the intermediate space is connected to the additional opening via at least one compressed-air passage directed through the lance head, and that the intermediate space is of annular design and concentrically surrounds the pilot-gas tube. The intermediate space may be formed in a simple manner by the (outer) pilot-gas tube of the lance being markedly reduced in outside diameter compared with the inner tube of the burner upstream of the lance head in the direction of flow. The inlet bores and compressed-air passages require only very slight changes to the burner or the lance head.

A further preferred embodiment of the burner arrangement according to the invention is defined in that a plurality of inlet bores are arranged so as to be distributed around the burner axis or lance axis, that a plurality of compressed-air passages are arranged so as to be distributed around the burner axis or lance axis, and that the compressed-air passages run obliquely toward the burner axis or lance axis in the direction of flow. An especially uniform and stable air shield is produced by this type of arrangement.

The outlet opening for the liquid fuel in the lance head is preferably arranged centrally, and the additional opening in the lance head is preferably designed as an annular opening which concentrically surrounds the central outlet opening for the liquid fuel. A gas envelope is thereby produced which encloses and shields in an annular manner the central outlet for the liquid fuel.

In a first alternative development of this embodiment, a plurality of outlet openings for the pilot gas are arranged so as to be distributed around the burner axis or lance axis, and the outlet openings lead into the annular opening. The outlet openings which are not being used and are intended for both fuels are thereby shielded in a simple manner.

In a second alternative development of this embodiment, a plurality of outlet openings for the pilot gas are arranged so as to be distributed around the burner axis or lance axis, and the outlet openings lie outside the annular opening. In addition to the shielding of the outlet openings which are not being used, separation by means of the air curtain between the inner outlet opening for the liquid fuel and the outer outlet opening for the pilot gas is thereby achieved.

Further embodiments follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3(*b*) shows a longitudinal section of the second preferred exemplary embodiment for a burner arrangement according to the invention;

FIG. 4(*b*) shows a longitudinal section of the third preferred exemplary embodiment for a burner arrangement according to the invention; and FIG. 4(*c*) shows a cross-section along plane C—C of FIG. 4 of the third preferred exemplary embodiment for a burner arrangement according to the invention.

DESCRIPTION OF THE PREFERRED EMBODIMENTS

Figure 2:
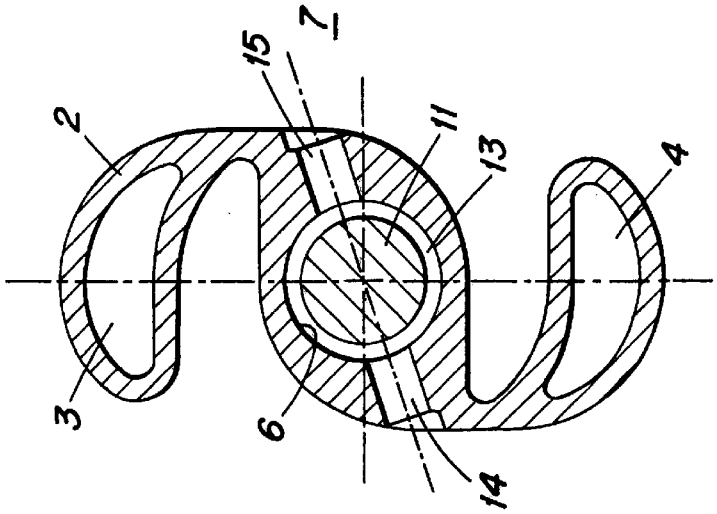
FIG. 2 shows a cross section through the burner arrangement according to FIG. 1 along plane A—A with the inlet bores for the shielding compressed air.
Figure 1:
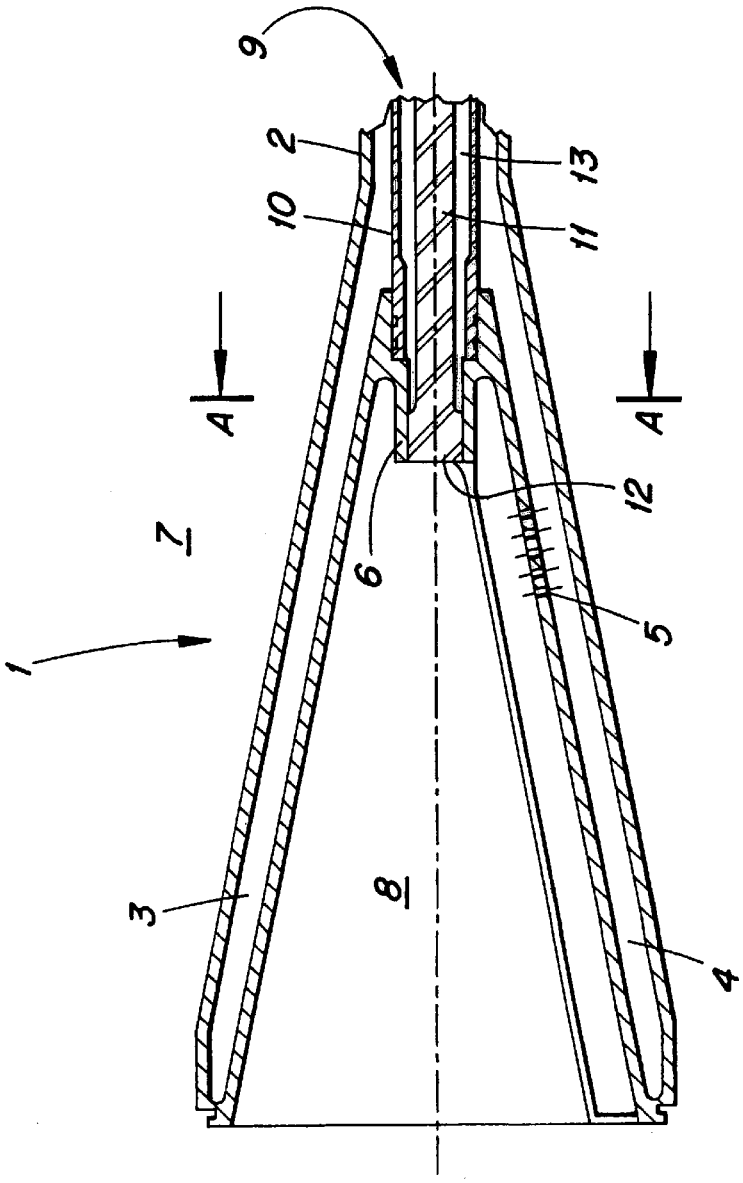
FIG. 1 shows a longitudinal section of a first general exemplary embodiment for a burner arrangement according to the present invention.

Referring now to the drawings, wherein like reference numerals designate identical or corresponding parts throughout the several views, in FIG. 1 a first general exemplary embodiment for a burner arrangement according to the present invention is reproduced in longitudinal section. The burner arrangement 1 comprises a burner 2, which in the present case is designed as a double-cone burner. The burner 2 encloses an injection space 8 which leads into a combustion chamber, which is not depicted (for this, see DE-A1-43 06 956). The burner is surrounded on the outside by the plenum 7 of the gas turbine, to which plenum compressed air is admitted from the compressor stage of the gas turbine. Arranged in the center of the burner 2 is an inner tube 6 into which a fuel lance 9 having an outer tube 10 and a lance tip is inserted, which fuel lance 9 comprises the end of a pilot-gas tube 11 and the adjoining lance head 12. Furthermore, the burner 2 comprises two outer main-gas passages 3 and 4 (see also FIG. 2) through which the main gas is fed and is injected into the injection space 8 through a multiplicity of inflow openings 5 (of which, for the sake of clarity, only five are depicted by way of example in FIG. 1.

The outside diameter of the pilot-gas tube 11 is markedly reduced (at least directly behind the lance head 12) compared with the inside diameter of the inner tube 6, so that an annular intermediate space 13 is obtained between the pilot-gas tube 11 and the inner tube 6. As becomes clear from the cross section in FIG. 2, compressed air from the surrounding plenum 7 can flow into this intermediate space 13 through two inlet bores 14 and 15, located opposite one another, and is available there for forming an air shield in the outlet region of the lance head 12. The forming of the air shield may be effected in different ways and is to be explained below with reference to two exemplary embodiments according to FIGS. 3 and 4, which for this purpose show the inner construction in the region of the lance head 12.

Figure 3B:
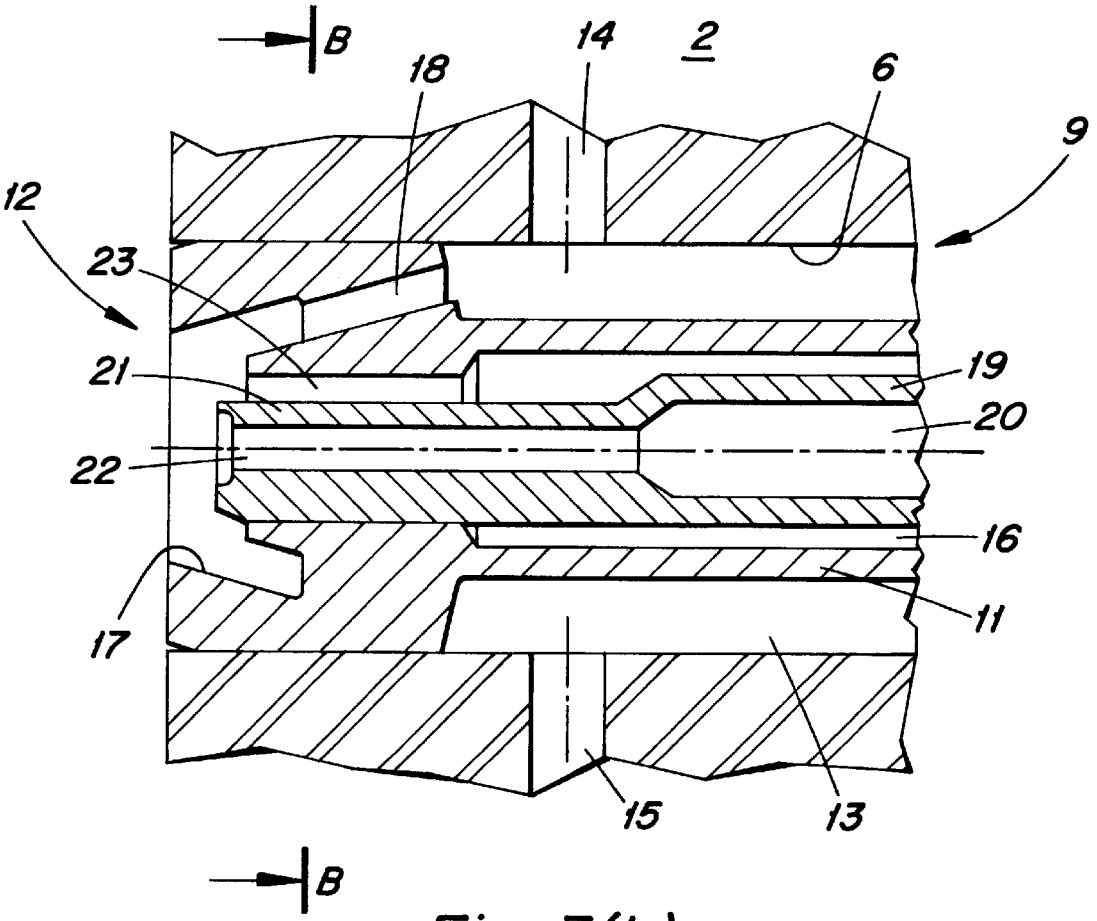
FIG. 3(*a*) shows a cross-section along plane B—B of FIG. 3(*b*) of a second preferred exemplary embodiment of a burner arrangement according to the invention with common annular opening for the compressed air and the pilot gas.
Figure 3A:
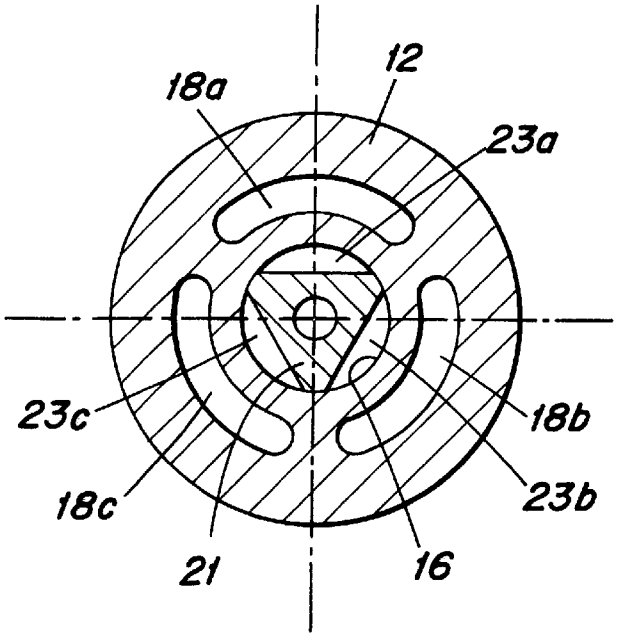

FIG. 3 shows a first exemplary embodiment in longitudinal section (part (*b*) of figure) and in cross section (part (*a*) of figure) along plane B—B from part (*b*) of figure. The fuel lance 9 in the inner tube 6 of the burner 2 comprises, in addition to the pilot-gas tube 11 already mentioned and the lance head 12, a liquid-fuel tube 19 arranged concentrically in the pilot-gas tube 11. The liquid fuel is fed in the central liquid-fuel passage 20 of the liquid-fuel tube during operation of the burner with liquid fuel (usually an oil/water mixture) and is injected into the injection space 8 through an associated outlet opening 22 in the lance head 12. During gas operation, pilot gas is fed in the pilot-gas passage 16 between the liquid-fuel tube 19 and the pilot-gas tube 11 and is injected into the injection chamber 8 through a plurality of outlet openings 23 and 23*a–c* in the lance head. The outlet openings 23*a–c* are formed by virtue of the liquid-fuel tube 19 having at the tip 21 a cross section in the form of a triangle inscribed in the circular bore of the pilot-gas tube 11 (see FIG. 3(*a*)).

To form the air shield, an annular opening 17 which concentrically surrounds the central outlet opening 22 of the liquid-fuel passage 20 is now provided in the front region of the lance head 12. The annular opening 17 is supplied with compressed air from the intermediate space 13 through a plurality of (three) compressed-air passages 18 and 18*a–c* which are arranged so as to be distributed around the lance axis. In this case, the compressed-air passages 18 and 18*a–c* lie in the radial direction outside the outlet openings 23 and 23*a–c*, which lead into the annular opening 17. The compressed-air passages 18 and 18*a–c* and the inner wall of the annular opening 17 are preferably designed to run obliquely toward the burner axis or lance axis. The issuing compressed air thereby forms a conically tapering air shield which is effective in preventing a backflow of hot gases and/or of hot oil from the injection space 8 into one of the outlet openings 22 and 23, 23*a–c* (not being used just at that moment).

Figures 4A, 4B, 4C:
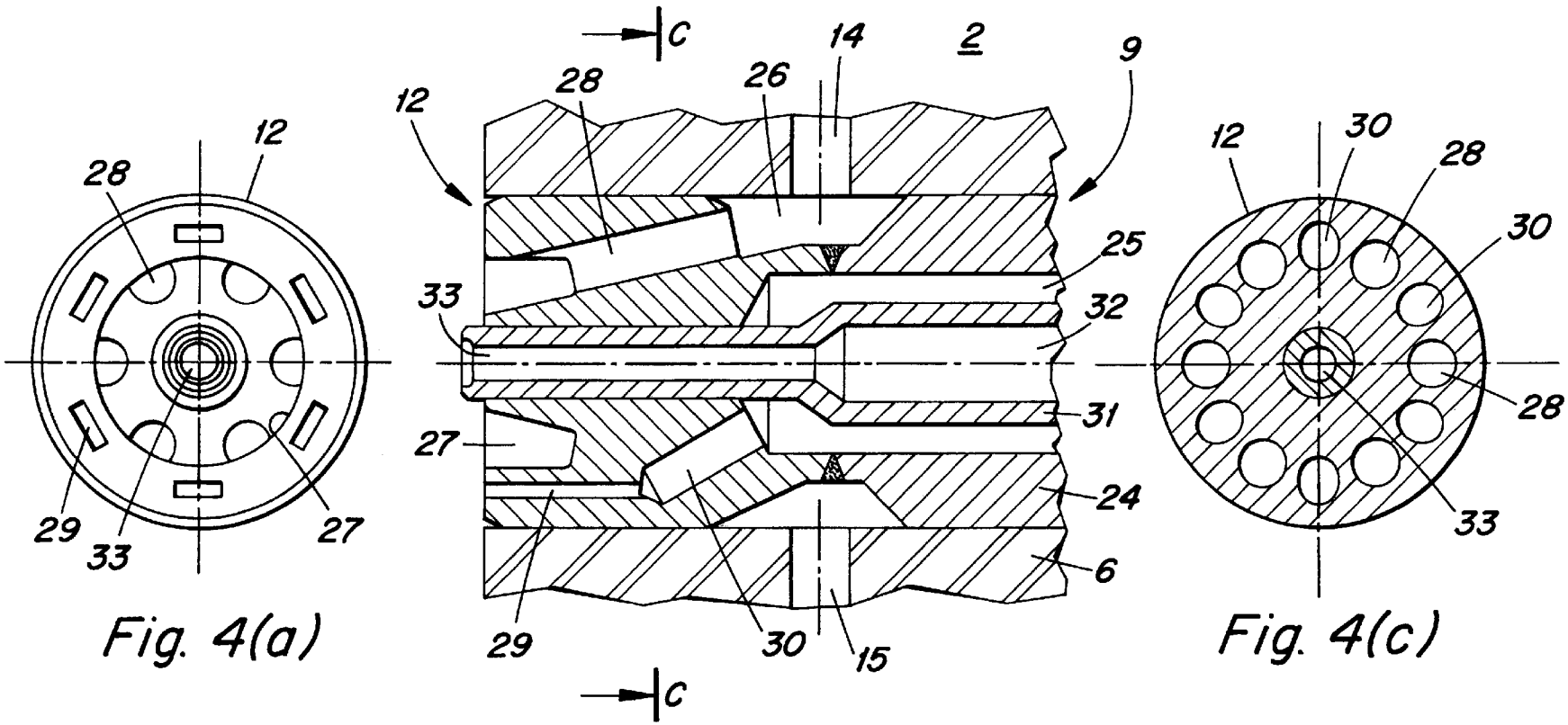
FIG. 4(*a*) shows a front view of a third preferred exemplary embodiment for a burner arrangement according to the invention with the air shield being placed between the liquid-fuel outlet and the pilot-gas outlet.

A second exemplary embodiment is reproduced in FIG. 4. Here, too, the fuel lance 9 in the inner tube 6 of the burner 2 comprises an outer pilot-gas tube 24 which concentrically surrounds a central liquid-fuel tube 31. The liquid-fuel and pilot-gas passages 32 and 25, respectively, formed by the two tubes 24 and 31 correspond to the passages 20 and 16 from FIG. 3. Here, too, the tubes 24 and 31 end in the lance head 12, which likewise has an annular opening 27 which concentrically surrounds the central outlet opening 33 for the liquid-fuel passage 32. The compressed air for the annular opening 27 is fed, via a plurality of (six) compressed-air passages 28 which are directed radially inward, from the annular intermediate space 26, which is connected to the plenum via the inlet bores 14, 15. In this exemplary embodiment, however, the pilot gas is not injected into the annular opening 27 but through a plurality of (six) separate outlet openings 29 which are connected to the pilot-gas passage 25 via corresponding pilot-gas bores 30.

In this case, the outlet openings 29 lie outside the annular opening 27. The air shield produced with the annular opening 27 thus not only shields the lance head 12 as a whole but also lies in a separating manner between the outlet openings 29 for the pilot gas and the outlet opening 33 for the liquid fuel, as a result of which in particular a backflow between the different outlet openings of the lance is prevented in an effective manner. In this arrangement, the restricted space in the lance head 12 is utilized especially effectively if the outlet openings 29 for the pilot gas and the pilot-gas bores 30 as well as the compressed-air passages 28 are arranged in an alternating manner around the burner axis or lance axis.

On the whole, the invention results in a burner arrangement in which, at little cost and in a simple manner, hot gases and/or hot oil can be prevented in an effective manner from flowing from the burner back into the passages of the burner lance which are not being used.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner arrangement for a gas turbine, comprising: at least one burner arranged in a plenum of the gas turbine and including an inner injection space which leads into a combustion chamber and into which compressed air is admitted from outside the burner from a compressor stage of the gas turbine, a fuel lance attached to the burner, the fuel lance including a central liquid-fuel tube and a pilot-gas tube concentrically surrounding the central liquid-fuel tube, the central liquid-fuel tube and the pilot-gas tube having outlet openings in a lance head located at a tip of the fuel lance, the fuel lance being inserted with the lance head into an inner tube which is in fluid communication with the injection space of the burner, an outer periphery of the lance head engaging an inner periphery of the inner tube, the lance head including an additional opening in an immediate vicinity of the outlet openings of the tubes for the flow of compressed air into the injection space and the lance head including means for directing compressed air from the plenum to the additional opening, the means for directing compressed air including an intermediate space arranged upstream of the lance head and located between the pilot-gas tube and the inner tube of the burner, the intermediate space being in fluid communication with the plenum surrounding the burner via at least one inlet bore extending through the burner into the inner tube, and the intermediate space being connected to the additional opening via at least one compressed air passage directed through the lance head the flow of compressed air through the additional opening preventing ingress of hot gases or hot liquids into the outlet openings of the liquid-fuel and pilot-gas tubes when either of the respective fuels exiting the fuel lance are not in use.

2. The burner arrangement as claimed in claim 1, wherein the intermediate space is annular and concentrically surrounds the pilot-gas tube.

3. The burner arrangement as claimed in claim 1, wherein a plurality of inlet bores are distributed around a burner axis or a lance axis.

4. The burner arrangement as claimed in claim 1, wherein a plurality of compressed-air passages are distributed around a burner axis or a lance axis.

5. The burner arrangement as claimed in claim 4, wherein the compressed-air passages run obliquely toward the burner axis or lance axis in a direction of flow of the compressed gas through the burner.

6. The burner arrangement as claimed in claim 1, wherein an outlet opening for the liquid fuel in the lance head is arranged centrally, and the additional opening in the lance head is an annular opening which concentrically surrounds the central outlet opening for the liquid fuel.

7. The burner arrangement as claimed in claim 6, wherein a plurality of outlet openings for the pilot-gas arc distributed around a burner axis or a lance axis, and the outlet openings lead into the annular opening.

8. The burner arrangement as claimed in claim 6, wherein a plurality of outlet openings for the pilot-gas are distributed around a burner axis or a lance axis, and the outlet openings lie outside the annular opening.

9. The burner arrangement as claimed in claim 8, wherein a plurality of compressed-air passages are distributed around a burner axis or a lance axis, and outlet openings of pilot-gas bores and the compressed-air passages are arranged in an alternating manner around the burner axis or lance axis.

10. The burner arrangement as claimed in claim 1, wherein the at least one inlet bore extends radially through the burner and the inner tube and into the inner tube.

* * * * *